US006647688B1

(12) United States Patent
Gaitan et al.

(10) Patent No.: US 6,647,688 B1
(45) Date of Patent: Nov. 18, 2003

(54) THERMOSET FLUORESCENT PIGMENTARY VINYL

(76) Inventors: Brenda S. Gaitan, P.O. Box 887, Whitwell, TN (US) 37397; Kevin L. Ballard, P. O. Box 187, Whitwell, TN (US) 37397

( * ) Notice: Subject to any disclaimer, the term of this patent is extended or adjusted under 35 U.S.C. 154(b) by 117 days.

(21) Appl. No.: 09/945,457

(22) Filed: Sep. 1, 2001

(51) Int. Cl.[7] ..... E04D 1/00

(52) U.S. Cl. ..... 52/518; 252/301.35; 252/583; 252/586; 428/457; 428/520; 428/522; 428/913

(58) Field of Search ..... 52/518; 428/195, 428/457, 520, 522, 913; 252/583, 586, 408.1, 700, 301.16, 301.35

(56) References Cited

U.S. PATENT DOCUMENTS 5,173,218 A 12/1992 Cohen et al.
5,215,679 A 6/1993 Cramm et al.
5,294,664 A 3/1994 Morrison, Jr. et al.
5,348,690 A 9/1994 Cohen et al.
RE35,007 E 8/1995 Cohen et al.
5,558,700 A * 9/1996 Shibahashi et al. ..... 106/21 A
5,644,013 A 7/1997 Yuan et al.
5,710,197 A 1/1998 Fischer et al.
5,714,090 A 2/1998 Waters et al.
5,792,813 A 8/1998 Yuan et al.
5,807,945 A 9/1998 Chen et al.
6,500,555 B1 * 12/2002 Khaldi ..... 428/457

* cited by examiner

*Primary Examiner*—Carl D. Friedman
*Assistant Examiner*—Yvonne M Horton
(74) *Attorney, Agent, or Firm*—John D. Gugliotta; P. Jeff Martin

(57) ABSTRACT

A thermoset fluorescent pigmentary vinyl is provided which is vinyl siding and trim components having luminescent characteristics. A thermoset fluorescent pigment which is charged by sunlight during the daytime hours and emits light during the nighttime hours.

8 Claims, 1 Drawing Sheet

THERMOSET FLUORESCENT PIGMENTARY VINYL

RELATED APPLICATIONS

The present invention was first described in Disclosure Document No. 480,408 filed on Sep. 28, 2000. There are no previously filed, nor currently any co-pending applications, anywhere in the world.

BACKGROUND OF THE INVENTION

1. Field of the Invention

The present invention relates generally to fluorescent emitting devices and, more particularly, to thermoset fluorescent pigmentary vinyl.

2. Description of the Related Art

Exterior decorating incorporates a wide variety of styles, borrowing ideas from cultures across the globe in order to achieve a unique, signature style for the house or building being decorated. For those who are on the cutting edge of modern exterior decorating practices, they know all too well that the various design methods are susceptible to the same type of trends or cyclical popularity as that experienced in the fashion world and other areas.

Accordingly, designers and manufacturers of items used on the exterior of homes or commercial buildings are constantly searching for the next idea that will allow a home or building to stand out from the rest. The development of the thermoset fluorescent pigmentary vinyl fulfills this need.

A search of the prior art did not disclose any patents that read directly on the claims of the instant invention; however, the following references were considered related. The following patents disclose a fluorescent organosilicone polymer: U.S. Pat. No. 5,792,813 issued in the name of Yuan et al.; and U.S. Pat. No. 5,644,013 issued in the name of Yuan et al.

The following patents describe a preparation of chemiluminescent vinyl halide or vinylidene polymer structures: U.S. Pat. No. 5,348,690 issued in the name of Cohen et al.; U.S. Pat. No. 5,173,218 issued in the name of Cohen et al.; and U.S. Pat. No. Re. 35,007 issued in the name of Cohen et al.

U.S. Pat. No. 5,807,945 issued in the name of Chen et al. discloses copolymers based on vinyl units and used in electro-luminescent arrangements.

U.S. Pat. No. 5,714,090 issued in the name of Waters et al. describes a solvent-resistant, non-formaldehyde, thermoset fluorescent pigment.

U.S. Pat. No. 5,710,197 issued in the name of Fischer et al. discloses cross-linked polymer particles containing a fluorescent dye.

U.S. Pat. No. 5,294,664 issued in the name of Morrison, Jr. et al. describes an aqueous dispersion of a fluorescent pigment.

U.S. Pat. No. 5,215,679 issued in the name of Cramm et al. discloses aqueous emulsions of resins containing a fluorescent dye.

Consequently, a need has been felt for providing a device which allows a home or building architecture to stand out amongst others in a manner which is quick, easy and efficient.

SUMMARY OF THE INVENTION

Therefore, it is an object of the present invention to provide glow in the dark siding which provides a unique appearance.

It is another object of the present invention to provide glow in the dark siding which emits a soft glow at night and which is aesthetically pleasing to one's eyes.

It is still another object of the present invention to provide a glow in the dark trim components for complimenting the siding.

It is still another object of the present invention to provide glow in the dark trim components which include window molding, edge trim, shutters and the like.

It is another object of the present invention to provide glow in the dark trim components which can be used by itself without siding for highlight emphasis.

It is another object of the present invention to provide vinyl siding and trim components colored by a thermoset fluorescent pigment comprised of a polymer matrix and a fluorescent dye.

It is another object of the present invention to provide vinyl siding and trim components colored by a thermoset fluorescent pigment which absorbs natural light during the day and emits a glowing light at night.

It is another object of the present invention to provide vinyl siding and trim components with a self-luminescent property which is added thereto during the manufacturing process.

Briefly described according to one embodiment of the present invention, thermoset fluorescent pigmentary vinyl is provided which is vinyl siding and trim components having luminescent characteristics. The invention is used to cover an entire home, or can simply be used on trim pieces such as moldings, soffits, shutters and the like. Upon initial observation of the invention on a home during daytime hours, nothing appears irregular. But when viewing the home at night, it can be seen that the invention emits a soft glow, producing a warm and aesthetically pleasing environment. The invention utilizes a thermoset fluorescent pigment which is charged by sunlight during the daytime hours and emits light during the nighttime hours.

The use of the present invention provides a means to allow home or building architecture to stand out from others in a manner which is not only quick, easy and efficient, but aesthetically pleasing as well.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
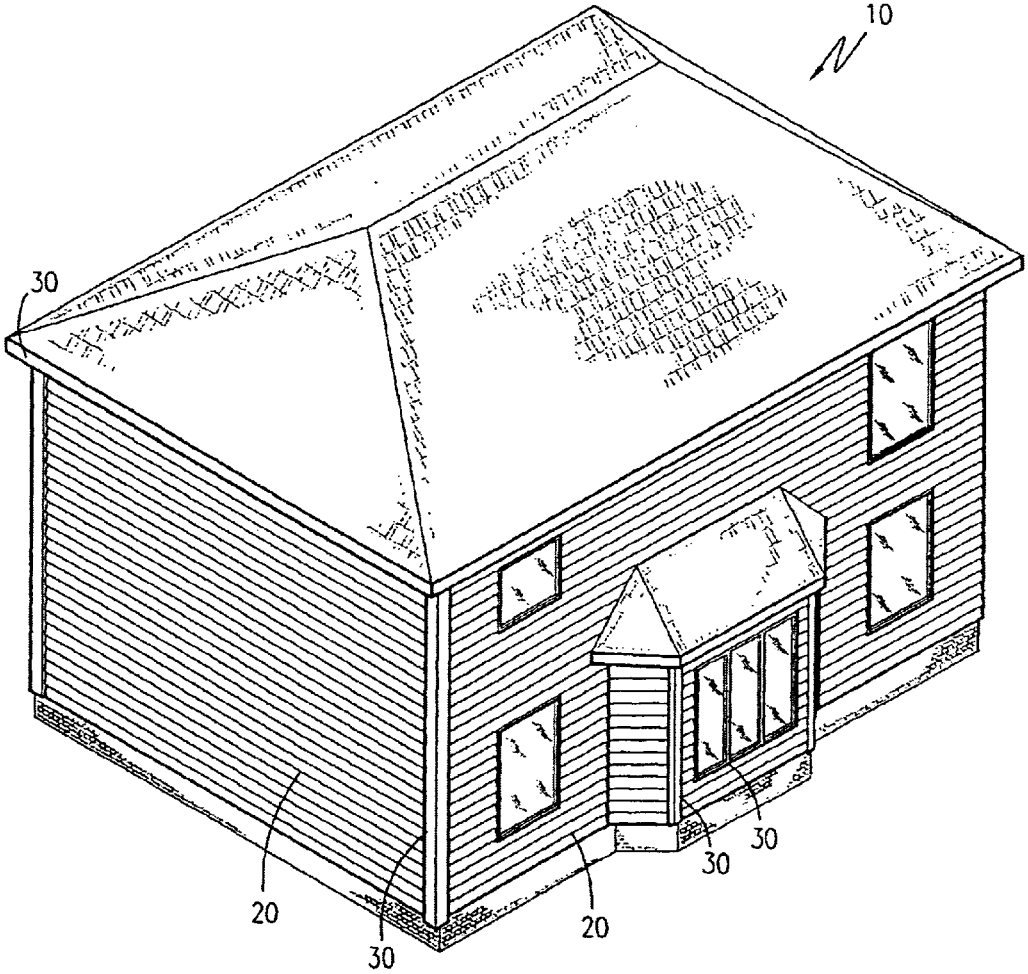
FIG. 1 is a perspective view of thermoset fluorescent pigmentary vinyl according to the preferred embodiment of the present invention.
Figure 2:
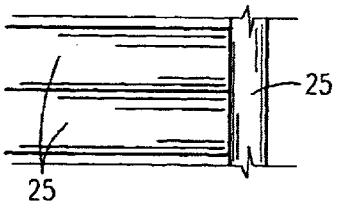
FIG. 2 is a partial side elevational view of the vinyl siding and trim component shown colored with the thermoset fluorescent pigment according to the preferred embodiment of the present invention.

Referring now to FIGS. 1–2, thermoset fluorescent pigmentary vinyl 10 is shown, according to the present invention, comprised of vinyl siding 20, colored with a thermoset fluorescent pigment 25, for use in covering a home so as to emit a soft glow. Although other uses, such as fencing, landscape edging, sign posts and poles, and other architectural and landscape elements can also enable the benefits of the present disclosure, for purposes of disclosing a best mode the vinyl siding 20 shall be used to describe the enablement of the present teachings.

Fluorescent pigments absorb radiation in ultraviolet and visible ranges of the spectrum, and by fluorescence, emit visible light. The fluorescent pigments are therefore charged by sunlight during daytime hours thus producing an emission of glowing light, the effect of which is particularly striking during nighttime hours.

According to the preferred embodiment, the thermoset fluorescent pigment 25 contains no formaldehyde and is solvent resistant to ketones, namely acetone. Thus, the thermoset fluorescent pigment 25 serves to provide an environmentally friendly compound, which will not dissolve or swell, and which will not bleed in a variety of solvents.

It is envisioned that trim components 30 for a home including moldings, soffits, shutters, and facias are also colored with the thermoset fluorescent pigment 25 for producing a warm glowing and aesthetically pleasing environment.

It is envisioned that the luminescent properties exhibited by the vinyl siding 20 and trim components 30 may alternatively be provided by coating the vinyl siding 20 and trim components 30 with zinc sulfide or strontium aluminate, thus the aforementioned means for coloring the siding 20 and trim components 30 is meant only as a suggestion and is in no way limiting.

The thermoset fluorescent pigment 25 is comprised of a polymer matrix and a fluorescent dye in an amount sufficient to impart fluorescent color to the thermoset fluorescent pigment.

The polymer matrix is comprised of approximately 15 to 50 mole percent of carboxylate functional oligomer; 30 to 80 mole percent of a metal ion; and 10 to 30 mole percent of a water insoluble resin.

After coloring the vinyl siding 20 and trim pieces 30 via thermoset fluorescent pigment 25, it is envisioned that the vinyl siding 20 and trim pieces 30 are shaped by injection molding process. However, other methods for shaping are envisioned and include casting, extruding, and blow molding; thus the shaping method disclosed according to the preferred embodiment is meant only as a suggestion and is in no way limiting.

2. Operation of the Preferred Embodiment

To use the present invention, the user simply covers the home with the thermoset fluorescent pigmentary vinyl siding and trim components as per the manufacturer's directions as would be followed when installing ordinary vinyl siding. It is the user's option to cover the entire home, or simply utilize trim components such as moldings, shutters, soffits, and the like for outlining the home. The luminescent properties of the vinyl siding and trim components have been added during the manufacturing process, thus once the user covers desired areas of the home, the vinyl siding and trim components will absorb sunlight during the day and will emit a luminescent glow at night.

The use of the present invention provides a means to allow home or building architecture to stand out from others in a manner which is not only quick, easy and efficient, but aesthetically pleasing as well.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. By way of example, and not by limitation, it can be easily seen that fencing, landscape edging, and other architectural and outdoor decorative elements can be made to incorporate the teachings of the present disclosure. Therefore, the scope of the invention is to be broadly limited only by the following claims.

What is claimed is:

1. A house exterior siding system formed of vinyl siding, said vinyl siding comprising:

vinyl siding colored with a fluorescent pigment for use in covering a home so as to emit a soft glow, wherein said fluorescent pigment is of thermoset type and wherein said thermoset fluorescent pigment contains no formaldehyde and is solvent resistant to ketones.

2. The vinyl siding of claim 1, further comprising moldings, soffits, shutters, and facias also colored with fluorescent pigment for producing a warm glowing and aesthetically pleasing environment.

3. The vinyl siding of claim 2, wherein said fluorescent pigment is comprised of a polymer matrix and a fluorescent dye in an amount sufficient to impart fluorescent color to the thermoset fluorescent pigment.

4. A house exterior siding system formed of vinyl siding, said vinyl siding comprising:

vinyl siding colored with a fluorescent pigment for use in covering a home so as to emit a soft glow, wherein said fluorescent pigment is provided by coating the vinyl siding with zinc sulfide.

5. A house exterior siding system formed of vinyl siding, said vinyl siding comprising:

vinyl siding colored with a fluorescent pigment for use in covering a home so as to emit a soft glow, wherein said fluorescent pigment is provided by coating the vinyl siding with strontium aluminate.

6. A house exterior siding system formed of vinyl siding, said vinyl siding comprising:

vinyl siding colored with a fluorescent pigment for use in covering a home so as to emit a soft glow; and moldings, soffits, shutters, and facias also colored with fluorescent pigment for producing a warm glowing and aesthetically pleasing environment;

wherein said fluorescent pigment is provided by coating the vinyl siding with zinc sulfide.

7. A house exterior siding system formed of vinyl siding, said vinyl siding comprising:

vinyl siding colored with a fluorescent pigment for use in covering a home so as to emit a soft glow; and moldings, soffits, shutters, and facias also colored with fluorescent pigment for producing a warm glowing and aesthetically pleasing environment wherein said fluorescent pigment is provided by coating the vinyl siding with strontium aluminate.

8. A house exterior siding system formed of vinyl siding, said vinyl siding comprising:

vinyl siding colored with a fluorescent pigment for use in covering a home so as to emit a soft glow, wherein said fluorescent pigment is comprised of a polymer matrix and a fluorescent dye in an amount sufficient to impart fluorescent color to the thermoset fluorescent pigment wherein said polymer matrix is comprised of approximately 15 to 50 mole percent of carboxylate functional oligomer; 30 to 80 mole percent of a metal ion; and 10 to 30 mole percent of a water insoluble resin.

* * * * *